US007596996B2

(12) United States Patent
Zollo et al.

(10) Patent No.: US 7,596,996 B2
(45) Date of Patent: Oct. 6, 2009

(54) CHRISTMAS TREE WITH INTERNALLY POSITIONED FLOWMETER

(75) Inventors: David Zollo, Houston, TX (US); Andrew Beck, Stirlingshire (GB); Sean Walters, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 11/737,285

(22) Filed: Apr. 19, 2007

(65) Prior Publication Data

US 2008/0257032 A1 Oct. 23, 2008

(51) Int. Cl.
*E21B 47/00* (2006.01)
*E21B 34/02* (2006.01)

(52) U.S. Cl. ..... 73/152.29; 166/348

(58) Field of Classification Search ..... 73/152.29, 73/152.31–152.35; 166/347, 348
See application file for complete search history.

(56) References Cited

U.S. PATENT DOCUMENTS

| | | | | | |
|---|---|---|---|---|---|
| 3,450,202 | A * | 6/1969 | Slack | 166/53 |
| 3,482,526 | A * | 12/1969 | Rich | 417/147 |
| 4,354,698 | A * | 10/1982 | Linder et al. | 285/98 |
| 4,542,788 | A * | 9/1985 | Semar | 166/217 |
| 5,135,684 | A * | 8/1992 | Mohn et al. | 261/76 |
| 5,971,077 | A | 10/1999 | Lilley | 166/368 |
| 6,032,737 | A | 3/2000 | Brady et al. | 166/265 |
| 6,134,951 | A | 10/2000 | Scott et al. | 73/61.44 |
| 6,234,030 | B1 | 5/2001 | Butler | 73/861.04 |
| 6,253,854 | B1 * | 7/2001 | Fenton | 166/364 |
| 6,460,621 | B2 | 10/2002 | Fenton et al. | 166/347 |
| 6,698,520 | B2 | 3/2004 | Fenton et al. | 166/347 |
| 7,114,571 | B2 | 10/2006 | Gatherar et al. | 166/367 |
| 7,201,229 | B2 * | 4/2007 | White et al. | 166/368 |
| 2002/0070026 | A1 | 6/2002 | Fenton et al. | 166/368 |
| 2003/0042025 | A1 | 3/2003 | Fenton et al. | 166/347 |
| 2005/0109514 | A1 | 5/2005 | White et al. | 166/368 |
| 2005/0121198 | A1 * | 6/2005 | Andrews | 166/368 |
| 2006/0131014 | A1 * | 6/2006 | Huang et al. | 166/250.07 |

FOREIGN PATENT DOCUMENTS

| | | |
|---|---|---|
| DE | 3609588 A1 | 3/1986 |
| GB | 2 101 496 A | 6/1982 |
| GB | 2 319 795 A | 6/1998 |
| WO | WO 00/40835 | 7/2000 |
| WO | WO 01/25593 A1 | 4/2001 |

OTHER PUBLICATIONS

PCT Search Report and Written Opinion from PCT/US2008/059851 dated Oct. 7, 2008.

* cited by examiner

*Primary Examiner*—John Fitzgerald
(74) *Attorney, Agent, or Firm*—Williams, Morgan & Amerson, P.C.

(57) ABSTRACT

A measurement device is disclosed which includes a structure adapted to be removably coupled to a Christmas tree, a sleeve operatively coupled to the structure and a flowmeter positioned at least partially within the sleeve.

29 Claims, 5 Drawing Sheets

FIG.3A
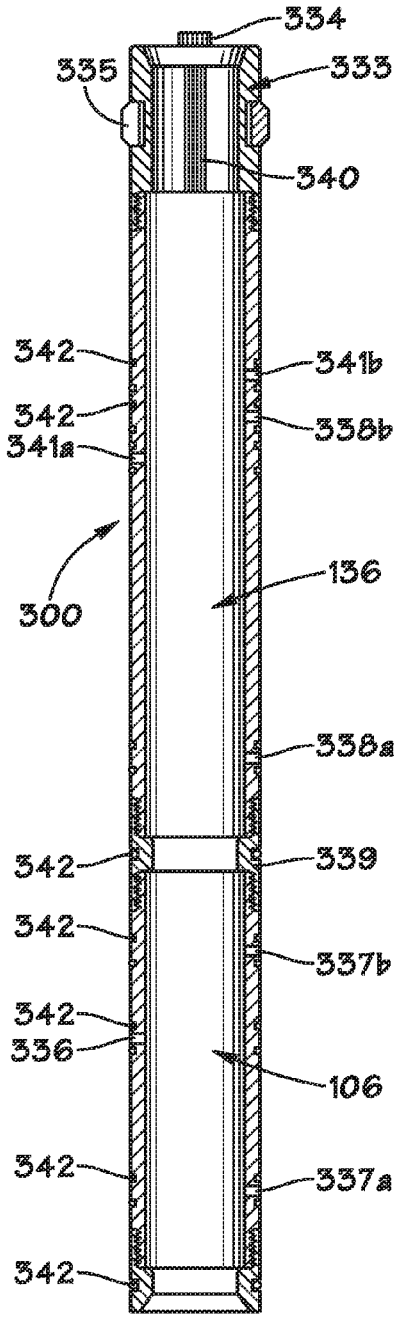
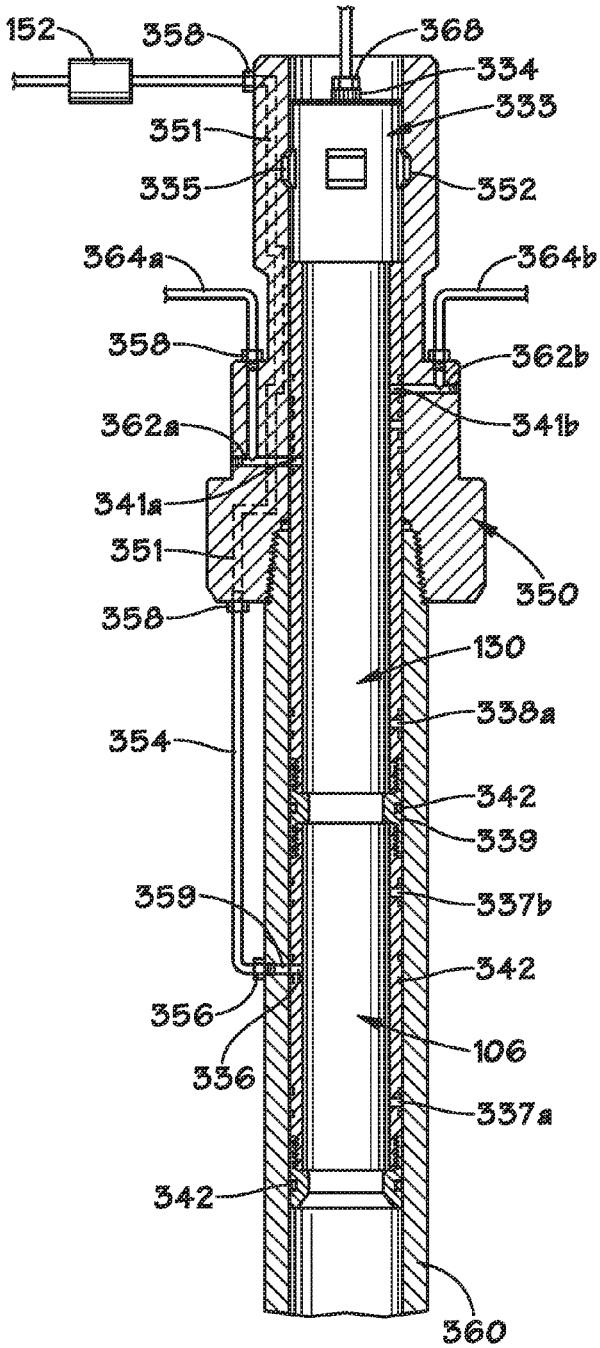
FIG.3B

CHRISTMAS TREE WITH INTERNALLY POSITIONED FLOWMETER

BACKGROUND OF THE INVENTION

1. Field of the Invention

The present invention is generally related to the field of oil and gas production equipment, and, more particularly, to a Christmas tree with an internally positioned flowmeter.

2. Description of the Related Art

In oil and gas wells, the produced fluid is often a combination of gas, oil and water. Production of oil and gas from a well normally involves the use of a series of inlet and outlet cutoff valves commonly referred to as a Christmas tree that is positioned above the wellhead. It is very important to be able to accurately meter the amount of oil and gas flowing from such wells. Multi-phase flowmeters have been developed that are able to measure the flow of each of the three phases—oil, gas and water—in a single production stream. However, such multi-phase flowmeters are typically less accurate when the volume percentage of gas, sometimes referred to as the "gas cut," is too high, e.g., greater than 97% or so. One known solution to such a problem involves separating some of the gas from the production stream to thereby reduce the gas cut. The separated gas flow is then measured by a separate gas meter, while the remaining production stream is measured using a multi-phase flowmeter. After the measuring step is performed, the two split streams are again combined downstream of the meters for transportation to a storage or production facility. In such a situation, the production stream from the well is separated only for metering purposes.

In multiple well situations, separate metering of the type just described is typically accomplished in one of two ways. One method involves routing the production flow from all of the wells to a single manifold. Thereafter, the combined flow from the manifold is then separated and metered as described above. This technique does not permit measurement of the production flow from each well independently.

Another method involves the use of an independent gas separator and metering unit which can be moved from well to well. Using this technique, the production flow from a particular well is temporarily re-routed through the gas separator/metering unit to measure the flow. While this technique enables the production flow of each well to be independently monitored, the flow from multiple wells cannot be monitored independently at the same time. Moreover, this latter technique involves repeated relocation of the gas separator/metering unit from well to well.

The present invention is directed to an apparatus and methods for solving, or at least reducing the effects of, some or all of the aforementioned problems.

SUMMARY OF THE INVENTION

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a measurement device is disclosed which comprises a structure adapted to be removably coupled to a Christmas tree, a sleeve operatively coupled to the structure and a flowmeter positioned at least partially within the sleeve.

In another illustrative embodiment, a measurement device is disclosed which comprises a tree cap adapted to be removably coupled to a Christmas tree, a sleeve operatively coupled to the tree cap and a flowmeter positioned at least partially within the sleeve, wherein the sleeve comprises a production fluid outlet opening formed in the sleeve in a position that is downstream of the flowmeter during normal operation of a well and a kill fluid inlet opening formed in the sleeve in a position that is downstream of the flowmeter during normal operation of a well.

In yet another illustrative embodiment, a system for measuring production flow from a well is disclosed which comprises a gas separator assembly that is adapted to be positioned above a wellhead and receive production flow from the well, the gas separator assembly comprising a gas separator device that is adapted to separate at least a portion of gas from the production flow, a flow measurement assembly adapted to be positioned downstream of the gas separator assembly, the flow measurement assembly comprising a flow measurement device that is adapted to receive and measure production flow after it has passed through the gas separator assembly, and a piping spool comprising a gas flowmeter, the gas flowmeter adapted to receive and measure gas separated from the production flow by the gas separator device.

In a further illustrative embodiment, a device for measuring production flow from a well is disclosed which comprises a gas separator assembly, the gas separator assembly comprising a gas separator device that is adapted to separate at least a portion of gas from the production flow, a flow measurement assembly positioned downstream of the gas separator device, the flow measurement assembly comprising a flow measurement device that is adapted to receive and measure production flow after it has passed through the gas separator assembly, and a housing that is adapted to be releasably coupled to a tubing hanger in the well, the gas separator assembly and the flow measurement assembly being operatively coupled to the housing.

BRIEF DESCRIPTION OF THE DRAWINGS

The invention may be understood by reference to the following description taken in conjunction with the accompanying drawings, in which like reference numerals identify like elements, and in which:

FIGS. 3A-3B are partial, cross-sectional views of yet another system comprising a separator assembly and flow measurement assembly that may be used in conjunction with a tubing hanger as disclosed herein.

Figure 1B:
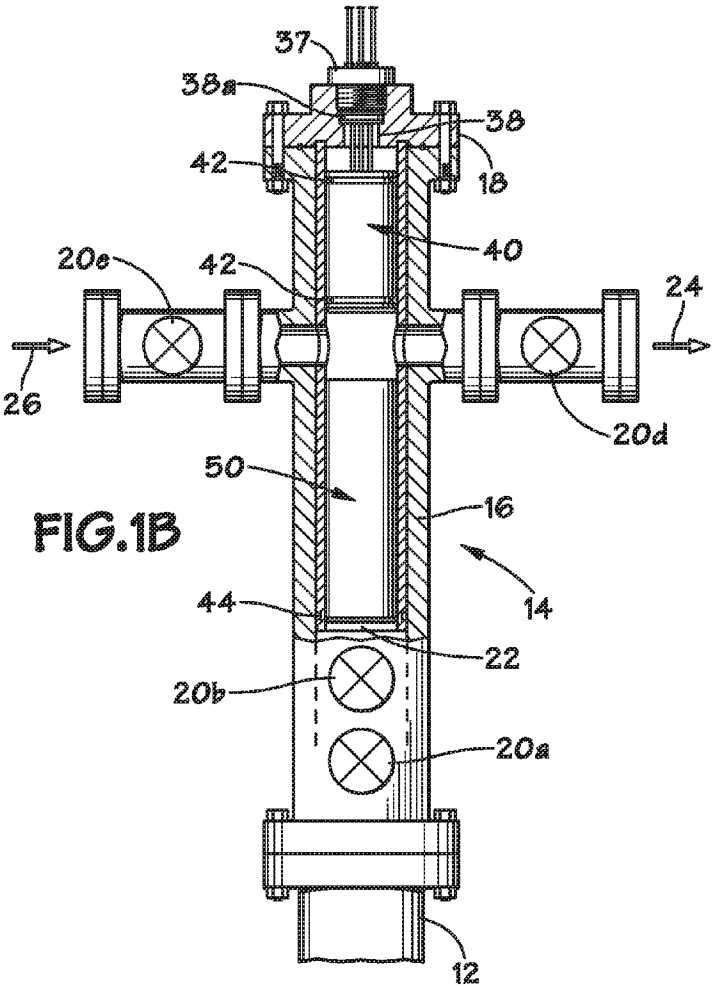
FIGS. 1A-1B are, respectively, a side view and a partial, cross-sectional view of one illustrative embodiment of the subject matter disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1A:
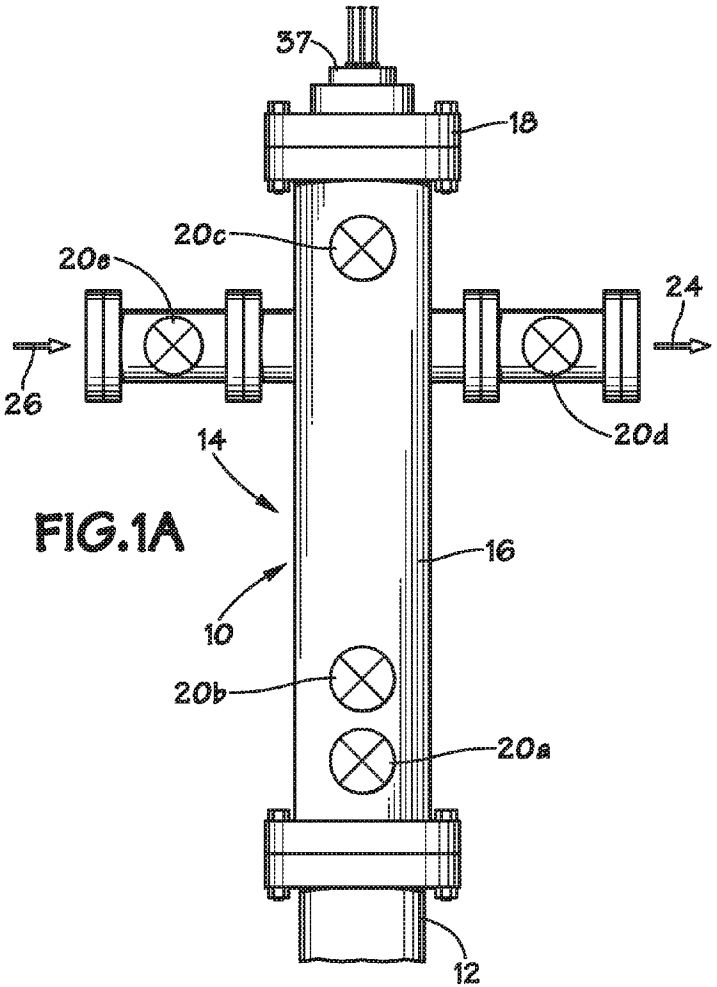

FIGS. 1A-1B depict an illustrative system 10 wherein one embodiment of the disclosed measuring system may be employed. As shown therein, a schematically depicted Christmas tree 14 is operatively coupled to a wellhead 12 such that production fluid from the well will flow through the Christmas tree 14. As will be appreciated by those skilled in the art after reading the present disclosure, the subject matter disclosed herein may be employed with subsea or surface wells, and with any type of Christmas tree 14, e.g., horizontal or vertical. Moreover, the term "Christmas tree" is believed to be well understood to those skilled in the art as a structure or body that comprises a plurality of valves used to control production from an oil or gas well.

In general, the Christmas tree 14 comprises a body 16, a cap 18 and a plurality of valves 20. The exact arrangement of the valves 20 may vary depending upon the particular application. In the depicted example, the tree 14 comprises a lower master valve 20*a*, an upper master valve 20*b*, a swab valve 20*c*, a production wing valve 20*d* and a kill wing valve 20*e*. In general, in operation, production flow from the well flows through the internal production passage 22 (see FIG. 1B) in the tree 14 and through the production wing valve 20*d* in the direction indicated by the arrow 24. At various times, a variety of fluids may be introduced through the kill wing valve 20*e* as indicated by the arrow 26. Such fluids may be introduced into the well for a variety of purposes, e.g., to kill the well.

The tree 14 may be coupled to the wellhead 12 using a variety of known techniques, e.g., a clamped or bolted connection. Additionally, additional components (not shown), such as a tubing head and/or adapter, may be positioned between the tree 14 and the wellhead 12. Thus, the illustrative arrangement of the schematically depicted tree 14 and wellhead 12 should not be considered a limitation of the present invention.

Figure 1D:
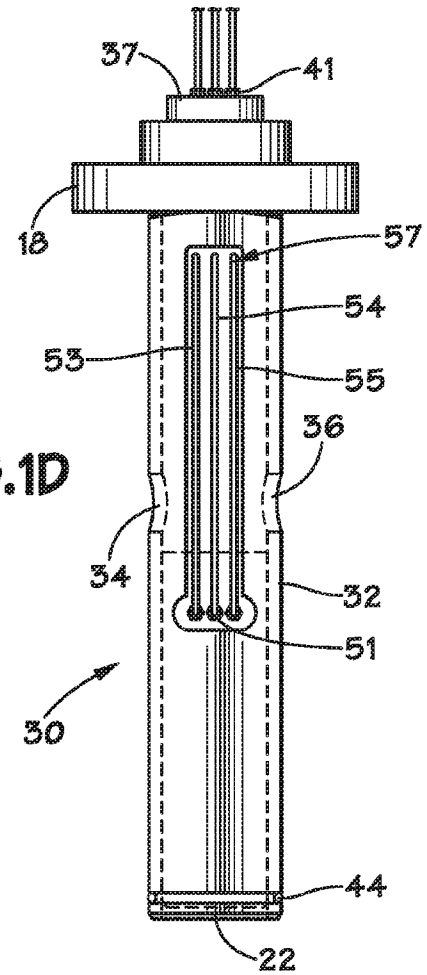
FIGS. 1C-1D are, respectively, a cross-sectional front view and a rear view of one illustrative embodiment of a measurement device disclosed herein.
Figure 1C:
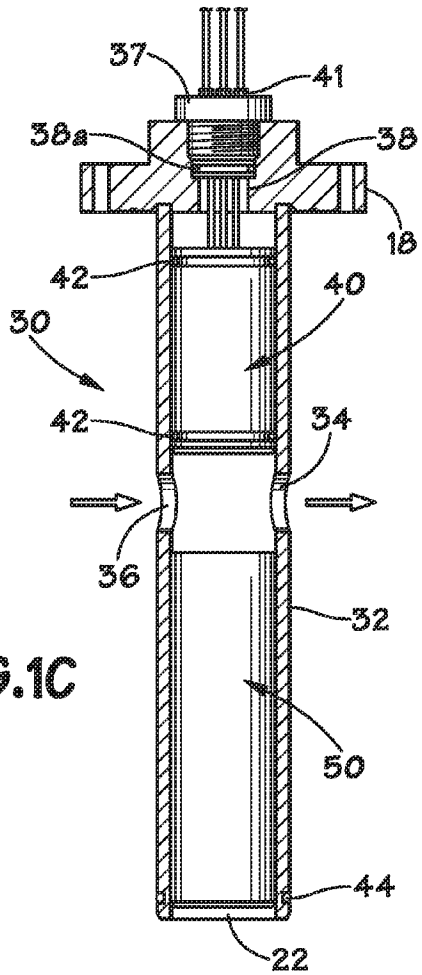

FIGS. 1C and 1D are, respectively, a cross-sectional view and a rear view of an illustrative measurement assembly 30 that generally comprises a sleeve 32 that is coupled to the tree cap 18, openings 34 and 36, a flow diverter or plug 40, and a measurement device 50. The opening 34 is adapted to be aligned with the production wing valve 20*d*, while the opening 36 is adapted to be aligned with the kill wing valve 20*e*. A bore 38 is provided in the tree cap 18 and a threaded electronics cap 37 is threadingly coupled to the tree cap 18. A seal 38*a*, e.g., an O-ring type seal, is provided between the electronics cap 37 and the bore 38 to establish a pressure-tight seal. A plurality of seals 42 may be provided with the flow diverter 40 to substantially prevent the flow of production fluids above the plug 40. One or more seals 44 may also be provided to define a seal between the outside diameter of the sleeve 32 and the inside diameter of the production passage 22 of the tree 14. See FIG. 1B. The seals 44 are provided to prevent or limit the amount of production fluid that might bypass the measurement device 50. Thus, the seals 44 do not establish a pressure seal between the sleeve 32 and the inside diameter of the production passage 22 in the tree 14. Similarly, the seals 42 adjacent the plug 40 do not establish a pressure-tight seal between the plug 40 and the inside diameter of the sleeve 32.

As shown in FIG. 1D, a plurality of slots 53, 54 and 55 are formed, e.g., milled, into the backside of the sleeve 32. The slots 53, 54 and 55 are adapted to receive, for example, 0.25" tubing. Standard tubing fittings 51 may be employed to secure one end of the tubing to the measurement system 50. Similarly, standard tubing fittings 41 are employed to sealingly couple the tubing to the electronics cap 37. The sleeve 32 is further provided with a plurality of openings 57 such that the tubing may be re-routed to the inside of the sleeve 32 above the flow diverter 40. In FIG. 1D, three illustrative tubing lines are shown, although the number may vary depending on the particular application. The tubing may be used for a variety of purposes, e.g., as conduit for electrical wiring, for differential pressure readings, etc.

The components depicted in FIGS. 1C and 1D may be made from a variety of materials, e.g., stainless steel, carbon steel, etc. The thickness of the sleeve 32 will vary based on venturi geometric requirements governed by average flow rates and well bore pressure seen in a given well. In one example, the sleeve 32 may have a thickness of approximately 1/16-1 inch.

The measurement device 50 may be comprised of any of a variety of known measurement utilities or devices, e.g., multiphase meters, vortex gas meters, separators, etc. The measurement device 50 may be secured within the sleeve 32 using a variety of known techniques, e.g., threaded connections, pin connections, snap rings, etc. The seals 42, 44 depicted herein may be made of any material sufficient to prevent or limit the bypass of production fluid under anticipated operating conditions. The measurement device 50 may be comprised of various internal components taken from any of a variety of different types of off-the-shelf measuring devices.

In normal operation, the measurement assembly 30 is positioned in the production passage 22 of the tree 14. Thereafter, production flow from the well is directed out the opening 34 in the sleeve 32 and through the production wing valve 20*d* in the direction indicated by the arrow 24. If desired, the measurement assembly 30 may be removed from the production passage 22 of the tree 14 by closing at least one of the valves 20*a*, 20*b* and decoupling the tree cap 18 from the tree 14. Thereafter, a traditional tree cap (not shown) may be coupled to the tree 14. The measurement device 50 measures the flow of the production fluid through the production passage 22 of the tree 14. Thus, using the measurement assembly 30 disclosed herein, each well may be provided with its own internally positioned measuring device to measure the flow from that well. The flow measurements can be made on a continuous or periodic basis.

Figure 2A:
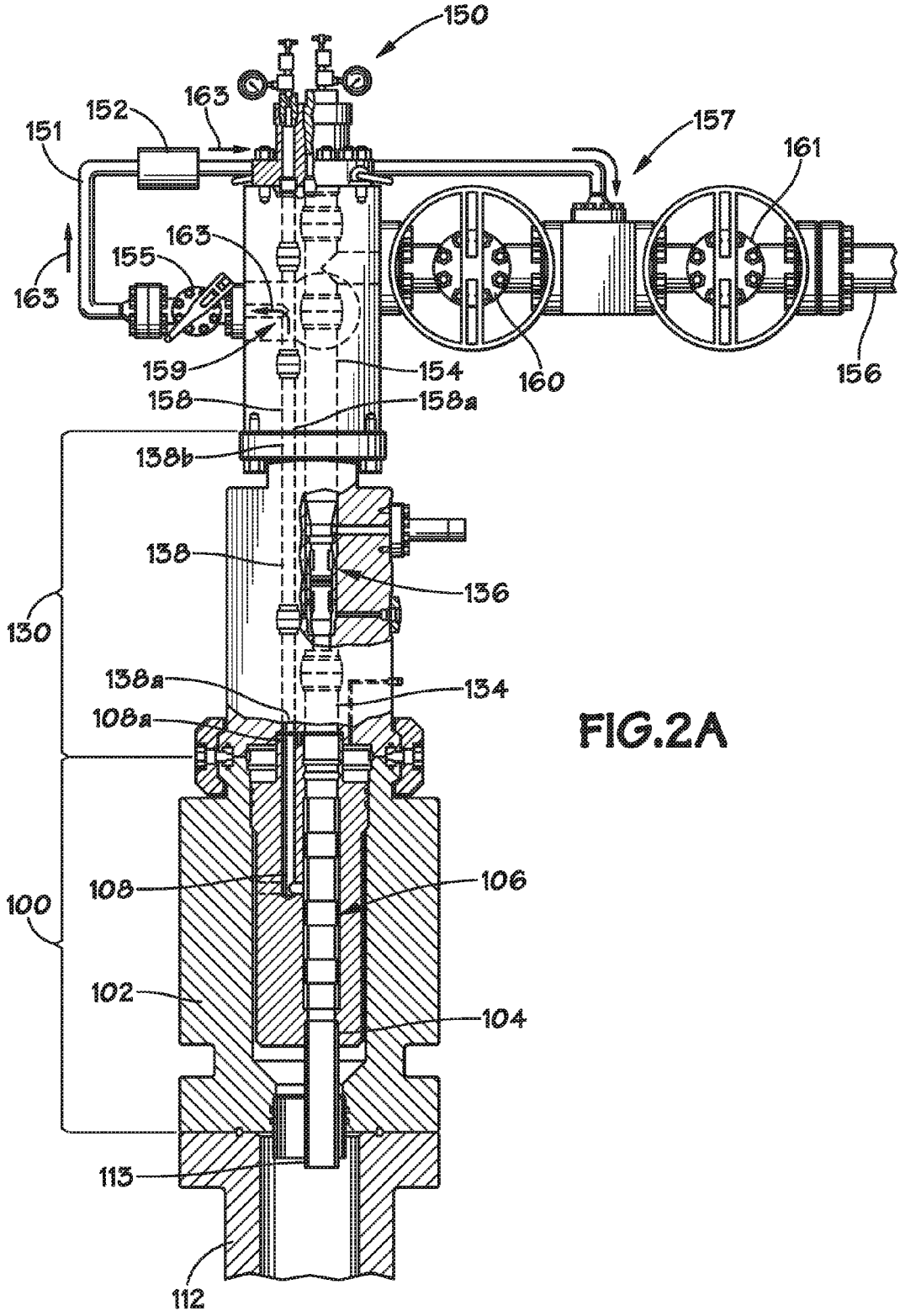
FIGS. 2A-2B are partial, cross-sectional views of a system comprising a separator assembly and flow measurement assembly as disclosed herein.

FIG. 2A depicts an embodiment wherein a separator assembly 100 and a measurement assembly 130 are positioned between the wellhead 112 and the tree 150 in an in-line arrangement. Of course, the illustrative arrangement depicted in FIG. 2A may vary depending upon the particular application. For example, one or more additional components, e.g., an adapter, a tubing head, etc., may be positioned between one or more of the components depicted in FIG. 2A. The various components depicted in FIG. 2A may be operatively coupled to one another using any traditional techniques, e.g., bolts, clamps, etc. Also depicted in FIG. 2A is production tubing 113 through which production fluid from the well will flow. In one example, the separator device 106 may be comprised of internals from a CDS in-line separator or other types of separator devices.

The separator assembly 100 comprises a body 102, a production passage 104, a separator device 106 positioned within the production passage 104, and a separated gas passage 108. As shown in this illustrative example, the production passage 104 is substantially aligned with the production tubing 113. The separator device 106 may be any type of separator device whereby a portion of the gas in the production fluid may be separated and directed to the separated gas passage 108. For example, the separator device may comprise one or more swirl elements that are adapted to cause the production fluid to swirl or rotate thereby tending to separate the gas and liquid in the production flow. The separator device 106 may be secured within the bore 104 using a variety of known techniques, e.g., landing a separation sleeve, with the entire separation device contained within, in a spool at the top of the tubing string.

The flow measurement assembly 130 is operatively coupled to and positioned downstream of the separator assembly 100. The flow measurement assembly 130 comprises a production passage 134, a measurement device 136 positioned within the production passage 134, and a separated gas passage 138. The outlet 108*a* of the separated gas passage 108 in the separator assembly 100 is adapted to be operatively coupled to the inlet 138*a* of the separated gas passage 138 in the flow measurement assembly 130. In the illustrative example depicted herein, the production passage 134 is substantially aligned with the production passage 104. Similarly, the separated gas passage 138 positioned in the flow measurement assembly 130 is substantially aligned with the separated gas passage 108. The measurement device 106 may be any type of multi-phase flowmeter that is capable of accurately measuring the gas and/or liquid content of the production flow after some of the gas has been separated from the production flow by use of the separator device 106. The measurement device 136 may be secured within the production passage 134 using a variety of known techniques, e.g., landing on a shoulder designed into the measurement spool, etc.

The tree 150 also comprises a production passage 154, a separated gas passage 158, a production wing valve 160 and a backup production wing valve 161. The outlet 138*b* of the separated gas passage 138 in the flow measurement assembly 130 is adapted to be operatively coupled to the inlet 158*a* of the separated gas passage 158 in the tree 150. The separated gas passage 158 in the tree 150 is in fluid communication with a pipe loop 151 that has a separated gas valve 155 and a gas meter 152 positioned therein. The gas meter 152 may be a traditional single phase type gas meter that is sufficient for measuring the quantity of gas flowing through the loop 151. At point 159, the separated gas flowing through passage 158 flows outward through the separated gas valve 155 and through the gas meter 152, as indicated by arrows 163. At point 157, the separated gas is recombined with the production fluid flowing through the production passages 134 and 154, and directed outward to the production flow line 156 through valve 161.

Figure 2B:
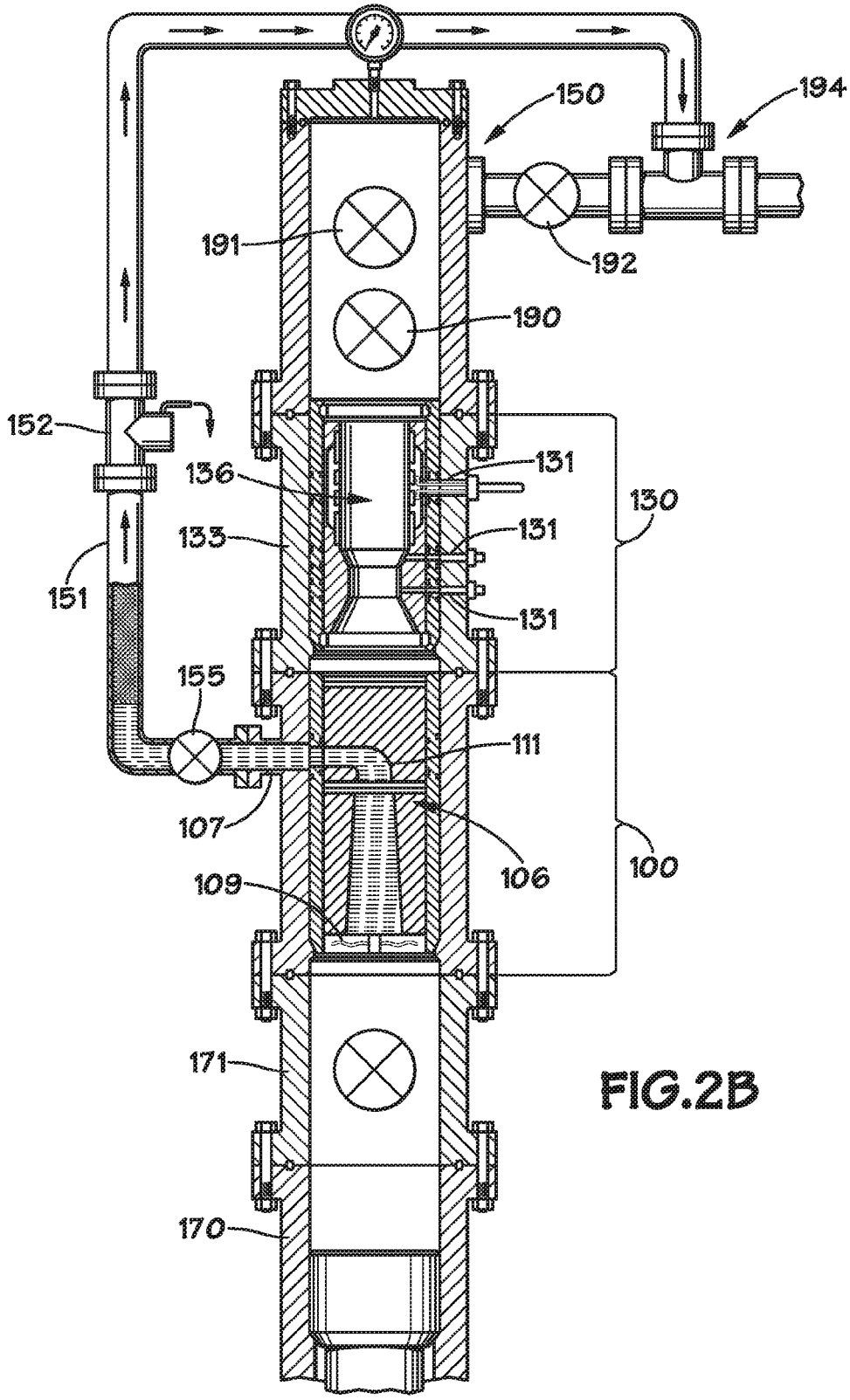

FIG. 2B depicts yet another illustrative embodiment of a separation assembly 100, a flow measurement assembly 130 and a tree 150. A tubing head 170 and tubing head adapter 171 are also schematically depicted in FIG. 2B. As before, the various components are provided by way of example only as the exact number and location of such components may vary depending on the application. Additionally, the various components depicted in FIG. 2B may be coupled to one another using any of a variety of known techniques, e.g., clamps, bolts, etc. The separation assembly 100 comprises a gas separation device 106 and a gas outlet 107. In this embodiment, the gas separation device 106 comprises a swirl element 109 and a gas collection device 111, e.g., a cone. The structure of such gas separation devices are well known to those skilled in the art.

The flow measurement assembly 130 comprises a measurement device 136 which may be, for example, a multiphase flowmeter. A plurality of penetrations 131 extend through the body 133 of the flow measurement assembly 130 to permit data from the measurement device 136 to be transmitted to a receiving device, such as a computer (not shown).

The tree 150 comprises a lower master valve 190, an upper master valve 191 and a production wing valve 192 in accordance with traditional construction. The system depicted in FIG. 2B further comprises a piping spool 151 having a gas meter 152 positioned therein. The gas meter 152 is adapted to measure the quantity of the separated gas from gas outlet 107 flowing through the piping spool 151 and provide such measurement data to a receiving device, e.g., a computer (not shown). The separated gas flowing through the loop 151 is ultimately recombined with the production flow through the tree 150 at point 194 downstream of the production wing valve 192.

FIGS. 3A-3B depict yet another illustrative embodiment of a measurement device 300 that may be employed in oil and gas wells. As shown therein, the device 300 comprises a housing 333, an engageable electrical connector 334, an actuatable clamp or dog mechanism 335 and the previously described gas separator device 106 and measuring device 136. The various components depicted in FIG. 3A may be coupled to one another using a variety of techniques. In the illustrative example depicted, the measurement device 136 is threadingly coupled to the housing 333 and the gas separator device 106 is threadingly coupled to the measurement device 136 via an internally threaded collar 339. A plurality of electrical wires 340 extend from the measurement device 136 to the engageable electrical connector 334, e.g., a multi-pin connector.

The gas separator device 106 further comprises a gas outlet opening 336, e.g., a ½" diameter opening, and a plurality of pressure equalization openings 337*a*, 337*b*. The measurement device 136 also comprises a plurality of pressure equalization openings 338*a*, 338*b*, and openings 341*a*, 341*b* for monitoring the differential pressure within the measurement device 136. A plurality of seals 342 are provided at various locations around the above-described penetrations in the gas separator device 106 and the measurement device 136.

As shown in FIG. 3B, the device 300 is adapted to be landed in a tubing hanger 350 positioned within a well. The tubing hanger 350 may be of traditional construction except for as described herein with respect to various details. In accordance with traditional practice, production tubing 360 is threadingly coupled to the tubing hanger 350. A gas outlet 359, e.g., a ½" opening, is formed in the production tubing 360 such that it is in fluid communication with the gas outlet 336 of the gas separator device 106. Tubing 354, e.g., ½" tubing, is employed, with fitting 356, to provide a flow path between the gas outlet 359 and the bottom of the tubing hanger 350. An internal separated gas passage 351 is formed in the tubing hanger 350 to accommodate the flow of the separated gas. The separated gas flows to a traditional gas meter 152 whereby the flow rate of the separated gas may be measured.

The tubing hanger 350 is also provided with internal flow paths 362*a*, 362*b* that are in fluid communication with the openings 341*a*, 341*b*, respectively. Control lines 364*a*, 364*b*, e.g., ¼" tubing, are in communication with flow paths 362*a*, 362*b*, respectively. Lines 364*a* and 364*b* are operatively coupled to a differential pressure sensor (not shown) to obtain desired differential pressure readings. Such differential pressure sensors are well known to those skilled in the art. Fittings 358 are used to coupled the control lines 364*a*, 364*b* to the tubing hanger 350. The locking dogs 335 are adapted to engage profile 352 formed in the tubing hanger 350. In one illustrative example, the locking dogs 335 may be adapted to engage a profile formed in the tubing hanger 350 for a back pressure valve (not shown). The locking dogs 335 may be of traditional construction and actuated using known techniques, e.g., hydraulics. An electrical connector 368 is adapted to be operatively connected to the connector 334 on the device 300 so that signals from the measurement device 136 may be transmitted to, for example, a computer.

In operation, the various connections involve the use of a fitting 358 are made prior to lowering the tubing hanger 350 and production tubing into the well. After the tubing hanger 350 is landed in the well, the connection between the connectors 368 and 334 may be made. In some cases, it may be desired or necessary to establish this connection using a traditional lubricator device, the structure and operation of which are well known to those skilled in the art. Such connections could also be made by known stab-in connection type devices.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A measurement housing, comprising:

a structure adapted to be removably coupled to a Christmas tree;

a sleeve operatively coupled to said structure; and a flowmeter positioned at least partially within said sleeve, wherein said sleeve further comprises a kill fluid inlet opening formed in said sleeve in a position that is downstream of said flowmeter during normal operation of a well and aligned with a kill flow path of the Christmas tree.

2. The device of claim 1, wherein said structure is a tree cap.

3. The device of claim 1, wherein said sleeve further comprises a production fluid outlet opening formed in said sleeve in a position that is downstream of said flowmeter during normal operation of a well.

4. The device of claim 1, wherein said flowmeter is a multi-phase flowmeter.

5. The device of claim 1, wherein said sleeve is adapted to be positioned at least partially within a production passage of said Christmas tree.

6. The device of claim 1, wherein said sleeve is adapted to be positioned entirely within a production passage of said Christmas tree.

7. The device of claim 1, further comprising a flow diverter positioned within said sleeve above said flowmeter.

8. The device of claim 7, wherein said flow diverter is a plug.

9. The device of claim 1, wherein said sleeve further comprises at least one recess in an outer surface of said sleeve that is adapted to receive a conduit positioned therein for transfer of measurement signals.

10. The device of claim 9, wherein said conduit comprises tubing.

11. The device of claim 1, wherein said structure further comprises a bore and an electronics cap that is sealingly engaged with said bore.

12. The device of claim 11, further comprising at least one opening in said electronics cap that is adapted to receive a conduit therein for transfer of measurement signals.

13. A measurement device, comprising:

a tree cap adapted to be removably coupled to a Christmas tree;

a sleeve operatively coupled to said tree cap; and a flowmeter positioned at least partially within said sleeve, wherein said sleeve comprises a production fluid outlet opening formed in said sleeve in a position that is downstream of said flowmeter during normal operation of a well and a kill fluid inlet opening formed in said sleeve in a position that is downstream of said flowmeter during normal operation of a well.

14. The device of claim 13, wherein said flowmeter is a multi-phase flowmeter.

15. The device of claim 13, wherein said sleeve is adapted to be positioned at least partially within a production passage of said Christmas tree.

16. The device of claim 13, wherein said tree cap further comprises a bore and an electronics cap that is sealingly engaged with said bore.

17. The device of claim 16, further comprising at least one opening in said electronics cap that is adapted to receive a conduit therein for transfer of measurement signals.

18. The device of claim 13, further comprising a flow diverter positioned within said sleeve above said flowmeter.

19. The device of claim 18, wherein said flow diverter is a plug.

20. The device of claim 13, wherein said sleeve further comprises at least one recess in an outer surface of said sleeve that is adapted to receive a conduit positioned therein.

21. The device of claim 20, wherein said conduit comprises tubing.

22. A measurement housing, comprising:

a structure adapted to be removably coupled to a Christmas tree;

a sleeve operatively coupled to said structure, wherein said sleeve is adapted to be positioned at least partially within a production passage of said Christmas tree; and a flowmeter positioned at least partially within said sleeve.

23. The device of claim 22, wherein said sleeve further comprises at least one recess in an outer surface of said sleeve that is adapted to receive a conduit positioned therein for transfer of measurement signals.

24. A measurement housing, comprising:

a structure adapted to be removably coupled to a Christmas tree;

a sleeve operatively coupled to said structure, wherein said sleeve is adapted to be positioned entirely within a production passage of said Christmas tree; and a flowmeter positioned at least partially within said sleeve.

25. The device of claim 24, wherein said sleeve further comprises at least one recess in an outer surface of said sleeve that is adapted to receive a conduit positioned therein for transfer of measurement signals.

26. A measurement housing, comprising:

a structure adapted to be removably coupled to a Christmas tree;

a sleeve operatively coupled to said structure, wherein said sleeve further comprises at least one recess in an outer surface of said sleeve that is adapted to receive a conduit positioned therein for transfer of measurement signals; and a flowmeter positioned at least partially within said sleeve.

27. The device of claim 26, wherein said conduit comprises tubing.

28. A measurement housing, comprising:

a structure adapted to be removably coupled to a Christmas tree;

a sleeve operatively coupled to said structure; and a flowmeter positioned at least partially within said sleeve, wherein said sleeve is adapted to be positioned at least partially within a production passage of said Christmas tree and wherein said sleeve further comprises a kill fluid inlet opening formed in said sleeve in a position that is downstream of said flowmeter during normal operation of a well and wherein said sleeve further comprises at least one recess in an outer surface of said sleeve that is adapted to receive a conduit positioned therein for transfer of measurement signals.

29. The device of claim 28, wherein said conduit comprises tubing.

* * * * *